US006591528B2

(12) United States Patent
Ellingsen

(10) Patent No.: US 6,591,528 B2
(45) Date of Patent: Jul. 15, 2003

(54) SUSPENSION DEVICE FOR A SHEET-SHAPED INFORMATION MEDIUM

(75) Inventor: John Petter Ellingsen, Oslo (NO)

(73) Assignees: Birgitte Ellingsen (NO); Ralph Petter Dyrnes (NO)

( * ) Notice: Subject to any disclaimer, the term of this patent is extended or adjusted under 35 U.S.C. 154(b) by 0 days.

(21) Appl. No.: 09/964,551

(22) Filed: Sep. 28, 2001

(65) Prior Publication Data

US 2002/0035799 A1 Mar. 28, 2002

(30) Foreign Application Priority Data

Sep. 28, 2000 (SE) ..... 0003488

(51) Int. Cl.[7] ..... G09F 7/00; G09F 7/22
(52) U.S. Cl. ..... 40/601; 40/617
(58) Field of Search ..... 40/601, 617; 160/333, 160/338, 339

(56) References Cited

U.S. PATENT DOCUMENTS 2,591,494 A * 4/1952 Asachika ..... 40/601
2,910,121 A * 10/1959 Stern et al. ..... 160/125
3,120,895 A * 2/1964 Mahana et al. ..... 160/125
3,673,720 A * 7/1972 Thornton ..... 40/601
5,471,774 A * 12/1995 Hoyt et al. ..... 40/601
5,471,775 A * 12/1995 Hoyt et al. ..... 40/601
5,941,001 A * 8/1999 Dietrich et al. ..... 160/338
6,055,754 A * 5/2000 Melhuus ..... 160/290.1

FOREIGN PATENT DOCUMENTS

WO WO 99/48077 9/1999

* cited by examiner

*Primary Examiner*—Brian K. Green
(74) *Attorney, Agent, or Firm*—Bacon & Thomas, PLLC

(57) ABSTRACT

A suspension device for attaching a sheet-shaped information medium to a wall including a first end wall element and a second end wall element carrying an end pulley each configured to be mounted onto a surface. The device further includes an upper bar carrying a pair of bar end pulleys disposed at opposed first and second end portions thereof and a lower bar cooperating with the upper bar to support the sheet-shaped information medium. An intermediate pulley system is provided that includes a pair of intermediate bar pulleys carried by the upper bar, and an intermediate wall element carrying an intermediate element pulley arranged to be positioned between the first and second end wall elements. A cord is provided that is secured to the first end wall element and extends through the plurality of pulleys carried by the upper bar and wall elements.

1 Claim, 1 Drawing Sheet

SUSPENSION DEVICE FOR A SHEET-SHAPED INFORMATION MEDIUM

FIELD OF THE INVENTION

The present invention relates to a suspension device for a sheet-shaped information medium, such as a poster or the like, for attachment to a wall or another surface, comprising an upper and a lower bar to which the information medium can be fastened, whereby the upper bar is connected to a cord system having pulleys, for raising and lowering relatively to elements attached to the wall or the like.

Such suspension devices can be used for all types of sheet-shaped information media, such as posters, and are in particular used for advertising posters. The devices permit a simple putting up and replacement of the posters, as an alternative to pasting on walls and the like. In order to be put up a poster can be fastened to the upper bar while this has been brought to a lowered position by use of the cord system, whereupon the poster and the bars are raised by use of the cord system. The lower bar will due to its own weight keep the poster stretched during raising, and at the end of the raising the lower bar can be hooked into lower elements attached to the wall, whereby the poster is kept stretched vertically in a suspended condition. The elements attached to the wall are presupposed to be able to hold the bars in such a mutual vertical distance that when the upper bar is fully raised and abuts the upper elements, the lower bar abuts the lower elements, whereby the poster is mainly kept stretched in the vertical direction. It is possible to mount springs, in or on the elements or in or on the bars, in order to compensate for a possible difference between the length of the actual poster being used and the length which the poster was intended to have, whereby the poster is stretched despite of this difference in length.

PRIOR ART

A cord system for such a suspension device appears from WO 99/48077, and comprises a single cord which is fastened to an upper element attached to the wall and which runs below two pulleys journalled in the upper bar in the vicinity of the ends thereof, and runs above a third pulley journalled in an upper element attached to the wall, and depends from this third pulley in order to be manipulated for raising and lowering.

Thus, the manipulation takes place by means of the single cord only. During raising the poster may take a slanting position, which is of no importance, because the upper bar will finally abut the two upper wall elements and take a horizontal position. What may occur during raising is that one end of the upper bar abuts one of the upper wall elements before the other end abuts the other wall element, i.e. that the bar is hanging obliquely, but continued pulling of the cord will pull the bar up until it has entered both of the upper wall elements and thus is horizontal. Upon raising of the poster the cord is fastened in a suitable manner.

When such a suspension device is to be used for posters having a large horizontal dimension, for instance several meters, the problem occurs that the upper bar must have a large bending stiffness and consequently has a large cross section, whereby it is heavy, in order not to flex. The result is that raising of the bars will require a large force, and the cord and the wall elements will have to withstand a large load. Flexing may cause that the poster buckles.

SUMMARY OF THE INVENTION

This problem is solved by the present invention. According to the invention the device comprises at least one additional wall element having a pulley for the cord, and the upper bar comprises at least two additional pulleys, whereby the cord runs via the additional wall element or elements. More than one additional wall element can be provided, and a corresponding number of pulleys can be provided in the wall elements and the upper bar. Thereby, the upper bar is suspended by the cord at least in three regions, and the bar will not flex even when it is of a large length.

The invention will in the following be explained more detailed, by means of an embodiment shown on the accompanying drawing.

DESCRIPTION OF AN EMBODIMENT

Figure 2:
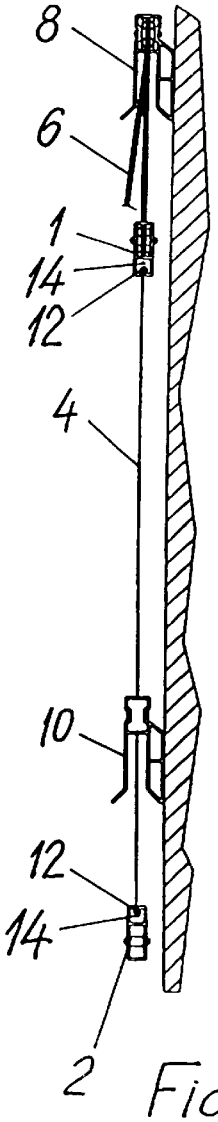
FIG. 2 shows a vertical section through the device and through a segment of a wall to which the device has been attached.
Figure 1:
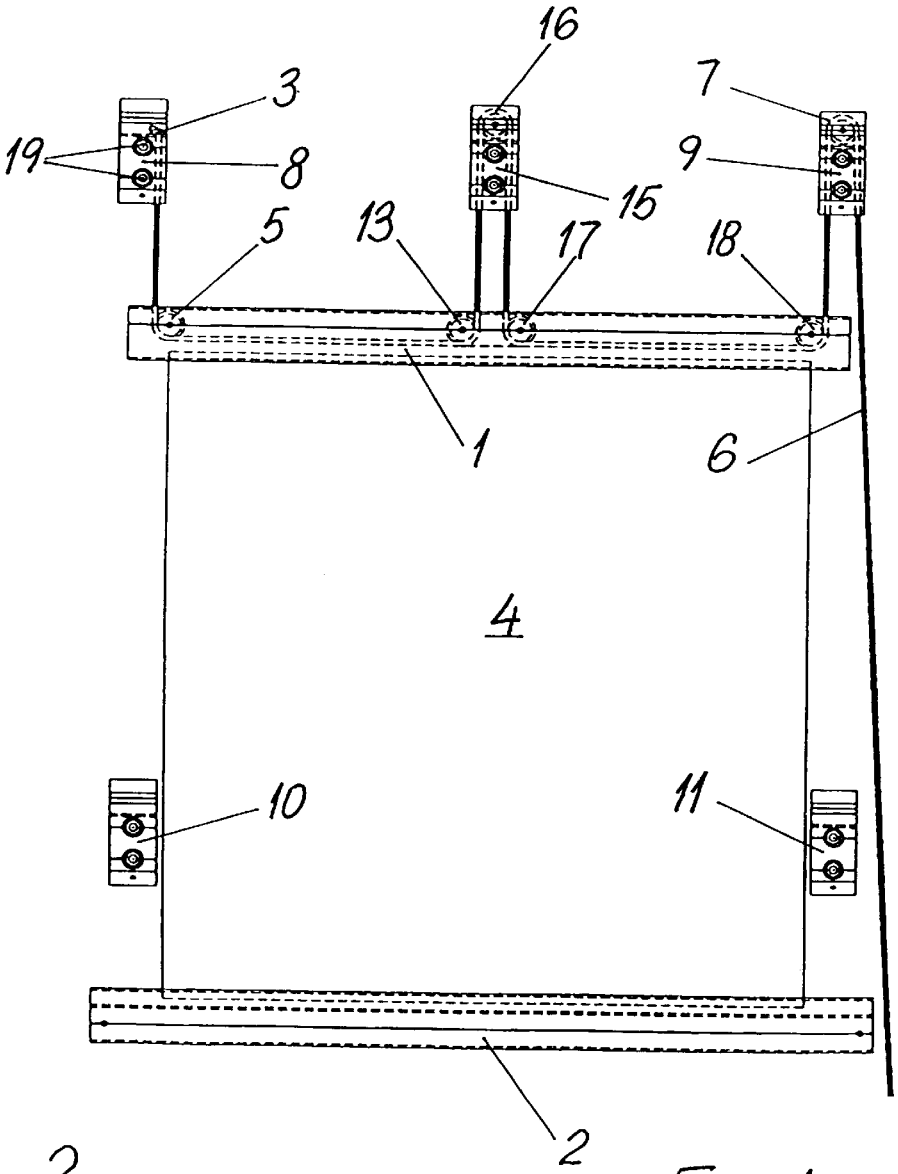
FIG. 1 shows a front view of an embodiment of a suspension device according to the invention, whereby a poster is about to be raised or lowered by use of the device.

A poster 4 is in FIG. 1 shown fastened to an upper bar 1 and a lower bar 2. The fastening can for instance be accomplished in that the poster 4 has a thickening 12 along its upper and lower edge, as shown in FIG. 2, whereby the thickenings are inserted in undercut grooves 14 in the bars 1 and 2, as shown in FIG. 2. Any other suitable means for fastening can be used within the scope of the invention.

Three upper wall elements 8, 9, 15 are attached, for instance by means of bolts 19, to a wall, along which the poster 4 is to be suspended. A cord 6 is, for instance by means of a knot 3, fastened to one wall element 8, as shown to the left in FIG. 1. The cord 6 runs below a first pulley 5 journalled in the upper bar 1, shown to the left in FIG. 1, whereupon the cord 6 runs horizontally along the bar 1 to a second pulley 13 journalled in the upper bar 1, shown approximately at the middle of the bar 1 in FIG. 1. Thereupon the cord 6 runs below the pulley 13 and upwardly to the second wall element 15, which in the embodiment shown is situated at the midpoint between the wall elements 8 and 9. The cord 6 runs above a pulley 16 in the wall element 15, as shown in FIG. 1. From the pulley 16 the cord 6 runs downwardly to a fourth pulley 17 journalled in the upper bar 1, and continues along the bar 1 to a fifth pulley 18 in the upper bar 1 and further to a sixth pulley 7 in the wall element 9. Therefrom the cord 6 depends, in order to be gripped for raising and lowering of the poster 4 and for being fastened in a suitable manner when the poster has been raised.

It will be appreciated that the invention is not restricted to the use of a single wall element in the middle and one pair of pulleys 13, 17 at the middle as shown, but that any number of wall elements between the wall elements 8 and 9 and a corresponding number of pairs of pulleys in the upper bar 1 in the principle can be provided.

By the invention is achieved that the upper bar 1 can be raised by being pulled up by the cord 6 in a plurality of points, at the pulleys 5, 13, 17, 18, and that the bar 1 will not flex even when it is of a large horizontal length.

Lower wall elements 10 and 11 may, as shown in FIG. 1, be attached to the wall, in order to keep the poster stretched in the vertical direction to a reasonable degree. These elements can be attached to the wall by bolts, correspondingly as for the wall elements 8, 9 and 15. The lower wall elements 10 and 11 constitute abutments for the lower bar 2, and provided that the length of the poster 4 in the vertical direction is adapted to the vertical distance between the wall elements 8, 9 and 10, 11, the upper end of the poster will be raised to such a degree that when the upper bar 1 has been inserted in the wall elements 8, 9 and 15 by pulling of the cord 6, the lower bar 2 has been inserted in the wall elements 10, 11. Not shown springs in or on the wall elements or in or on the bars may be used in order to compensate for a possible difference in vertical length for the poster 4 relatively to its intended length, when the poster is shorter than its intended length, whereby the poster 4 despite such a difference will be kept stretched in the vertical direction to a reasonable degree.

As shown in FIG. 2, the wall elements 8, 9, 15 and 10, 11 may be have a shape which facilitates entering of the bars from below.

It will be appreciated that the two wall elements 8, 10 to the left in FIG. 1 can be combined into a vertical girder along one side of the poster and that the two wall elements 9, 11 to the right can be correspondingly combined into a vertical girder along the opposite side of the poster. Alternatively, a vertical decorative moulding may be fastened along each side, in order that the wall elements together with the bars shall have the appearance of a complete frame.

The wall elements 8, 9, 15 and 10, 11 as well as the bars 1 and 2 can be manufactured in any convenient manner, for instance from metal or plastics. In the embodiment shown the bars 1 and 2 can conveniently be made from extruded profiles, which are drilled for making the holes necessary for the cord 6 and the journalling of the pulleys 5, 13, 17, 18. Also the wall elements 8, 9, 15 and 10, 11 can be made from extruded profiles, and the upper wall elements are drilled for making holes for the cord 6 and the bolts 19, and moreover the upper wall elements 9 and 15 are drilled for making holes for journalling of the pulleys 7 and 16.

What is claimed is:

1. A suspension device for attaching a sheet-shaped information medium to a wall, the device comprising:

a first end wall element configured to be mounted onto the wall;

a second end wall element carrying an end pulley and configured to be mounted onto the wall;

an upper bar carrying a first bar pulley disposed at a first end portion thereof and a second bar pulley disposed at a second end portion thereof opposite to the first end portion;

a lower bar cooperating with the upper bar to support the sheet-shaped information medium;

at least one intermediate pulley system including a pair of intermediate bar pulleys carried by the upper bar, and an intermediate wall element carrying an intermediate element pulley and configured to be mounted onto the wall, said pair of intermediate bar pulleys positioned in a region below the intermediate wall element, the at least one intermediate pulley system arranged to be positioned between the first and second end wall elements; and a single cord having a first end arranged to be secured to the first end wall element and a second end arranged to extend through the first bar pulley to the at least one intermediate pulley system to the second bar pulley and to the end pulley of the second end wall element, whereby the second cord end extends from the end pulley to be manipulated for lowering and raising said sheet-shaped information medium.

* * * * *